US008399377B2

(12) United States Patent
Miki et al.

(10) Patent No.: US 8,399,377 B2
(45) Date of Patent: Mar. 19, 2013

(54) THERMAL TRANSFER IMAGE-RECEIVING SHEET AND METHOD FOR PRODUCING SAME

(75) Inventors: Masaaki Miki, Ashigarakami-gun (JP); Takuya Arai, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 422 days.

(21) Appl. No.: 12/749,162

(22) Filed: Mar. 29, 2010

(65) Prior Publication Data

US 2010/0247815 A1 Sep. 30, 2010

(30) Foreign Application Priority Data

Mar. 30, 2009 (JP) ..... 2009-080940

(51) Int. Cl.
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS 7,485,402 B2 2/2009 Arai et al.

FOREIGN PATENT DOCUMENTS

| | | | |
|---|---|---|---|
| JP | 2004-009572 | * | 1/2004 |
| JP | 2008-246943 A | | 10/2008 |
| JP | 2008-296528 A | | 12/2008 |

* cited by examiner

*Primary Examiner* — Bruce H Hess
(74) *Attorney, Agent, or Firm* — Sughrue Mion, PLLC

(57) ABSTRACT

A thermal transfer image-receiving sheet having, on a support, at least one heat-insulating layer and at least one receiving layer on the heat-insulating layer, wherein the heat-insulating layer contains hollow polymer particles, gelatin and a latex having a glass transition temperature of from 30 to 85° C., and the molecular chain of the polymer constituting the latex has a styrene recurring unit and a butadiene recurring unit.

20 Claims, No Drawings

THERMAL TRANSFER IMAGE-RECEIVING SHEET AND METHOD FOR PRODUCING SAME

CROSS-REFERENCE TO RELATED APPLICATIONS

The present application claims the benefit of priority from Japanese Patent Application No. 2009-080940, filed on Mar. 30, 2009, the contents of which are herein incorporated by reference in their entirety.

BACKGROUND OF THE INVENTION

1. Field of the Invention

The present invention relates to a thermal transfer image-receiving sheet and a method for producing it. In particular, the invention is to provide a thermal transfer image-receiving sheet excellent in transfer density, free from pressure influence on the transfer density and excellent in image storability after printing, and to provide a method for producing it.

2. Description of the Related Art

Heretofore, various thermal transfer recording methods are known. Above all, a dye diffusion transfer recording system is specifically noted as a process capable of producing color hard copies of which the image quality is the nearest to that of silver salt photographs. Moreover, as compared with silver salt photographs, the system has other various advantages in that it is a dry system, it can produce visible images directly from digital data, and it is simple in image duplication.

In the dye diffusion transfer recording system, a colorant (or dye)-containing thermal transfer sheet (hereinafter referred to as "ink sheet") and a thermal transfer image-receiving sheet (hereinafter referred to as "image-receiving sheet") are put one upon another, and thermal transfer sheet is heated with a thermal head from which the heat generation is ontrolled by electric signals given thereto, whereby the colorant in the thermal transfer sheet is transferred onto the thermal transfer image-receiving sheet for image information recording thereon. In this, three colors of cyan, magenta and yellow, or four colors of these and black are recorded as superimposed, thereby giving a color image having a continuously changing color density in a mode of transfer recording. In the dye diffusion transfer process, the ink sheet and the image-receiving sheet must be kept in close contact with each other. Accordingly, for obtaining high-quality prints having high image uniformity, the image-receiving sheet is required to have good smoothness.

With the recent development of digital imaging technology by computer, the quality of recorded images is bettered and the market of the dye diffusion transfer recording system is expanding, and with that, the demand for high-speed and high-density printing systems is increasing.

The thermal transfer image-receiving sheet for the system comprises, as formed on a support, an image-receiving layer on which the transferred colorant is fixed. It is known that a heat-insulating layer containing hollow particles is formed on the support to thereby enhance the colorant transferability owing to the heat-insulating effect of the pores that the hollow particles have. JP-A 2008-246943 discloses a method for producing an image-receiving sheet having a high print density and good smoothness according to a simultaneous multilayer coating method. The simultaneous multilayer coating method is a production method of excellent producibility for image-receiving sheets, in which gelatin is effectively used.

This is because gelatin has the property of readily gelling, and it enables high-speed coating by cooling immediately after coating with it, therefore preventing interlayer color mixing. However, the film after gelled shrinks owing to water vapor evaporation, and therefore the hollow particles in the heat-insulating layer are crushed. Consequently, there is a problem in that the hollow particles could not fully exhibit the heat-insulating property thereof.

JP-A 2008-296528 discloses an image-receiving sheet having a high image density and good image uniformity, in which the heat-insulating low-density layer contains hollow particles, a hydrophobic resin adhesive and a hydrophilic adhesive. As the hydrophobic resin adhesive, used are a polybutadiene resin and a styrene-butadiene-acrylonitrile copolymer resin having a glass transition temperature of not higher than 10° C.; and as the hydrophilic adhesive, used is polyvinyl alcohol. The publication shows the effect of the sheet that yields little by pressure.

However, when the composition is applied to simultaneous multilayer coating method, high-speed coating with it is difficult and the composition could not fully prevent trouble of interlayer color mixing. When gelatin is used as the hydrophilic adhesive for gellation, the hollow particles are much crushed and the image density greatly lowers.

Consequently, it is desired to provide a thermal transfer image-receiving sheet having good transferability based on the heat-insulating property of the hollow particles therein and having high smoothness based on the advantage of the simultaneous multilayer coating method.

SUMMARY OF THE INVENTION

An object of the invention is to provide a thermal transfer image-receiving sheet having high smoothness and high robustness and capable of forming high-quality images thereon, and to provide a method for producing it. Concretely, the invention is to provide a thermal transfer image-receiving sheet having high smoothness, excellent in transfer density, free from pressure influence on the transfer density and free from trouble of image bleeding in prints after aging, and to provide a method for producing it.

The present inventors have assiduously studied and, as a result, have found that the above-mentioned objects can be attained by the following means.

[1] A thermal transfer image-receiving sheet having, on a support, at least one heat-insulating layer and at least one receiving layer on the heat-insulating layer, wherein the heat-insulating layer contains hollow polymer particles, gelatin and a latex having a glass transition temperature (hereinafter referred to as Tg) of from 30 to 85° C., and the molecular chain of the polymer constituting the latex has a styrene recurring unit and a butadiene recurring unit.

[2] The thermal transfer image-receiving sheet of [1], wherein the ratio by mass of the solid content (a) of the gelatin to the solid content (b) of the latex in the heat-insulating layer, (a)/(b), is from 30/70 to 70/30.

[3] The thermal transfer image-receiving sheet of [1] or [2], wherein the receiving layer contains a polymer latex or a water-soluble polymer.

[4] The thermal transfer image-receiving sheet of any one of [1] to [3], which is wound up into a roll.

[5] A method for producing the thermal transfer image-receiving sheet of anyone of [1] to [4], which comprises simultaneously coating on a support:

a coating liquid for heat-insulating layer containing hollow polymer particles, gelatin and a latex having a glass transition temperature of from 30 to 85° C., wherein the molecular chain of the polymer constituting the latex has a styrene recurring unit and a butadiene recurring unit, and a coating liquid for receiving layer superimposed on the coating liquid for heat-insulating layer.

According to the invention, there are provided a thermal transfer image-receiving sheet having high smoothness, excellent in transfer density, free from pressure influence on the transfer density and free from trouble of image bleeding in prints after aging, and a method for producing it.

BEST MODE FOR CARRYING OUT THE INVENTION

The invention is described in detail hereinunder. In this description, the numerical range expressed by the wording "a number to another number" means the range that falls between the former number indicating the lowermost limit of the range and the latter number indicating the uppermost limit thereof. In this description, the polymer latex is meant to indicate a dispersion of fine particles of a water-insoluble hydrophobic polymer dispersed in a water-soluble dispersant. The state of dispersion may be in any form of emulsification of a polymer in a dispersant, or emulsion polymerization thereof, or micellar dispersion thereof, or molecular dispersion of the molecular chains themselves of polymer particles partially having a hydrophilic structure therein.

[Thermal Transfer Image-Receiving Sheet]

The thermal transfer image-receiving sheet of the invention (hereinafter this may be referred to as "image-receiving sheet of the invention") is a thermal transfer image-receiving sheet having at least one heat-insulating layer (porous layer) and at least one receiving layer (dye-receiving layer) sequentially on a support, in which the heat-insulating layer contains hollow polymer particles, gelatin and a latex having a glass transition temperature of from 30 to 85° C., and the molecular chain of the polymer constituting the latex has a styrene recurring unit and a butadiene recurring unit. The thermal transfer image-receiving sheet is described below.

The thermal transfer image-receiving sheet of the invention may have interlayers with, given thereto, various functions of, for example, white background regulation, static charge prevention, adhesiveness, cushionability, smoothness, barrier capability or the like, between the support and the receiving layer. If desired, a release layer may be formed on the outermost layer of the sheet that is placed on a transfer sheet.

On the other side of the support opposite to the side thereof coated with the receiving layer, a curling preventing layer, a writing layer and an antistatic layer may be provided.

<Heat-Insulating Layer>

The thermal transfer image-receiving sheet of the invention has at least one heat-insulating layer, and, the heat-insulating layer contains hollow particles, gelatin and a latex having a glass transition temperature of from 30 to 85° C., in which the molecular chain of the polymer constituting the latex has a styrene recurring unit and a butadiene recurring unit. The sheet may have two or more such heat-insulating layers, and in a preferred embodiment of the invention, two or more heat-insulating layers are provided between the receiving layer and the support.

(Hollow Polymer Particles)

In the invention, the heat-insulating layer contains hollow polymer particles.

The hollow polymer particles (hereinafter this may be referred to as "hollow particles") in the invention are polymer particles having a hollow inside the particles. The hollow particles are preferably in the form of aqueous dispersion, including, for example, 1) non-foaming hollow polymer particles of such that a dispersant such as water is inside the partitioning walls formed of polystyrene, acrylic resin, styrene-acrylic resin or the like, and after coating and drying, the dispersant inside the particles is evaporated away from the particles to give hollow particles; 2) foaming microballoons of such that a low-boiling-point liquid such as butane, pentane or the like is enveloped with a resin comprising any of polyvinylidene chloride, polyacrylonitrile, polyacrylic acid, polyacrylate, or their mixture or polymer, and after coating, the low-boiling-point liquid inside the particles is expanded by heating to give, a hollow space inside the foamed particles; 3) microballoons prepared by previously heating and foaming the above 2) to be hollow particles; etc.

Of those, the hollow particles in the invention are preferably the above-mentioned 1) non-foaming hollow polymer particles, and if desired, two or more different types of those hollow polymer particles may be mixed for use herein. Their concrete examples are Rohm & Haas' Rohpake HP-1055, JSR's SX866 (B), Nippon Zeon's Nipol MH5055 (all trade names).

Preferably, the mean particle size of the hollow particles is from 0.5 μm to 5.0 μm, more preferably from 0.5 μm to 2.0 μm. In case where the mean particle size of the hollow particles is not too small, the porosity of the film may be planned high and therefore the film may have high heat insulation; and in case where the mean particle size of the hollow particles are not too large, the hollow particles may be hardly crushed owing to the film shrinkage in the drying step during film production.

The mean particle size of the hollow particles for use in the invention may be computed as follows: Using a transmission electronic microscope, the circle-equivalent outer diameter of each particle is measured, and the data are averaged. Concretely, at least 300 hollow particles are analyzed with a transmission electronic microscope, and the circle-equivalent outer diameter of each particle is measured, and the data are averaged.

Preferably, the hollow particles for use in the invention have a degree of hollowness of from 20 to 80% or so, more preferably from 30 to 70% or so. In case where the degree of hollowness is not too low, the film may have high heat insulation; and when not too high, the strength of the hollow particles does not lower and the hollow particles are hardly crushed owing to the film shrinkage in the drying step during film production.

The degree of hollowness of the hollow particles for use in the invention may be computed as follows: Using a transmission electronic microscope, at least 300 hollow particles are analyzed, and the mean circle-equivalent outer diameter (R1) and the mean circle-equivalent inner diameter (R2) are computed, from which the ratio of the volume of the hollow part to the particle volume $(R2/R1)^3 \times 100$ is computed to be the degree of hollowness of the hollow particles.

Preferably, the hollow particles have a glass transition temperature (Tg) of from 70° C. to 200° C., more preferably from 90° C. to 180° C.

As the hollow particles, especially preferred is a latex of hollow polymer particles such as a polymer latex prepared by dispersing hollow particles in water.

In the invention, in case where the sheet has two or more heat-insulating layers, for example, preferred is an embodiment where the heat-insulating layers are two layers of an upper heat-insulating layer and a lower heat-insulating layer. In this case, preferably, the hollow polymer particles to be in the upper heat-insulating layer and the lower heat-insulating layer are designed as follows, from the viewpoint of forming a heat-insulating layer constitution that has high heat insulation and is hardly influenced by pressure.

Preferably, the mean particle size of the hollow polymer particles in the upper heat-insulating layer is larger than that of the hollow polymer particles in the lower heat-insulating layer.

Preferably, the content of the hollow polymer particles in the lower heat-insulating layer is larger than that of the hollow polymer particles in the upper heat-insulating layer.

(Gelatin)

The heat-insulating layer in the invention contains gelatin. In the producing process, gelatin for use in the invention may be any of unextracted gelatin, alkali-processed (lime-processed) gelatin prepared by dipping in an alkali bath, acid-processed gelatin prepared by dipping in an acid bath, double-processed gelatin prepared by dipping the two baths, and enzyme-processed gelatin. Gelatin for use in the invention may have a molecular weight of from 10,000 to 1,000,000. Gelatin for use in the invention may contain an anion such as $Cl^-$, $SO_4^{2-}$, etc., and may contain a cation such as $Fe^{2+}$, $Ca^{2+}$, $Mg^{2+}$, $Sn^{2+}$, $Zn^{2+}$, etc. Preferably, gelatin is dissolved in water and added.

(Water-Soluble Polymer for Combination Use)

Any other water-soluble polymer than gelatin may be in the heat-insulating layer. The other water-soluble polymer than gelatin usable in the invention includes natural polymers (polysaccharides, microorganismic polymers, animal-derived polymers), semisynthetic polymers (cellulosic polymers, starch-type polymers, alginic acid-type polymers) and synthetic polymers (vinylic polymers and others). In addition, other synthetic polymers such as typically polyvinyl alcohol to be mentioned below, as well as natural or semisynthetic polymers starting from vegetable-derived cellulose or the like are to fall in the category of the water-soluble polymer for use in the invention.

Of the other water-soluble polymers than gelatin for use in the invention, natural polymers and semisynthetic polymers are described in detail. Vegetable-derived polysaccharides include gum arabic, κ-carrageenan, ι-carrageenan, λ-carrageenan, guar gum (Squalon's Superol, etc.), locust bean gum, pectin, tragacanth, corn starch (National Starch & Chemical's Purity-21, etc.), phosphorylated starch (National Starch & Chemical's National 78-1898, etc.), etc.; microorganismic polysaccharides include xanthan gum (Kelco's Keltrol T, etc.), dextrin (National Starch & Chemical's Nadex 360, etc.), etc.; animal-derived natural polymers include casein, sodium chondroitin sulfate (Croda's Cromoist CS, etc.), etc. (These are all trade names.) Cellulosic polymers include ethyl cellulose (ICI's Cellofas WLD, etc.), carboxymethyl cellulose (Daicel's CMC, etc.), hydroxyethyl cellulose (Daicel's HEC, etc.), hydroxypropyl cellulose (Aqualon's Klucel, etc.), methyl cellulose (Henkel's Viscontran, etc.), nitrocellulose (Hercules' Isopropyl Wet, etc.), cationated cellulose (Croda's Crodacel QM, etc.), etc. (These are all trade names.) Starch-type polymers include phosphorylated starch (National Starch & Chemical's National 78-1898, etc.); alginic acid-type polymers include sodium alginate (Kelco's. Keltone, etc.), propylene glycol alginate, etc.; and other polymers include cationated guar gum (Alcolac's Hi-Care 1000, etc.), sodium hyaluronate (Lifecare Biomedial's Hyalure, etc.). (These are all Trade Names.)

Of the other water-soluble polymers than gelatin for use in combination in the invention, synthetic polymers are described in detail. Acrylic polymers include sodium polyarylate, polyacrylic acid copolymer, polyacrylamide, polyacrylamide copolymer, polydiethylaminoethyl (meth)acrylate quaternary salt or copolymer, etc.; vinylic polymers include polyvinylpyrrolidone, polyvinylpyrrolidone copolymer, polyvinyl alcohol, etc.; and other polymers include polyethylene glycol, polypropylene glycol, polyisopropylacrylamide, polymethyl vinyl ether, polyethyleneimine, polystyrenesulfonic acid and its copolymer, naphthalenesulfonic acid condensate salt, polyvinylsulfonic acid and its copolymer, polyacrylic acid and its copolymer, acrylic acid and its copolymer, etc., maleic acid copolymer, maleic monoester copolymer, acryloylmethylpropanesulfonic acid and its copolymer, etc., polydimethyldiallylammonium chloride and its copolymer, polyamidine and its copolymer, polyimidazoline, dicyandiamide condensate, epichlorohydrin/dimethylamine condensate, Hoffman degraded polyacrylamide, water-soluble polyester (Goo Chemical's Plascoat Z-221, Z-446, Z-561, Z-450, Z-565, Z-850, Z-3308, RZ-105, RZ-570, Z-730, RZ-142—all trade names), etc.

Also usable herein are high water-absorption polymers described in U.S. Pat. No. 4,960,681 and JP-A 62-245260, or that is, homopolymers of vinyl monomer having —COOM or —$SO_3M$ (where M is a hydrogen atom or an alkali metal) or copolymers of those vinyl monomers or the vinyl monomer with any other vinyl monomer (e.g., sodium methacrylate, ammonium methacrylate), such as Sumitomo Chemical's Sumikagel L-5H (trade name), etc.

(Latex of Polymer having Styrene and Butadiene Recurring Units in the Molecular Chain of the Polymer)

In the invention, the heat-insulating layer contains a latex of polymer having a styrene recurring unit and a butadiene recurring unit in the molecular chain of the polymer and having a glass transition temperature of from 30 to 85° C. In this description, the latex of polymer having a styrene recurring unit and a butadiene recurring unit in the molecular chain of the polymer may be referred to as "styrene-butadiene latex" for convenience sake.

The styrene-butadiene latex having Tg of from 30 to 85° C. is excellent over any other latex than styrene-butadiene latex but having Tg of from 30 to 85° C. in that it may form a heat-insulating layer hardly influenced by pressure.

The present inventors have known that, when a heat-insulating layer is formed by the use of gelatin and hollow particles, then the hollow particles are crushed and the heat insulation of the layer is thereby lowered. The inventors have further known that the crushing of hollow particles is remarkable when the heat-insulating layer and the receiving layer are formed by the simultaneous multilayer coating method. Not adhering to any theory, it is presumed that the crushing of hollow particles would be caused by shrinkage of the gelatin-containing coating layer through drying and by pressure given to the entire film.

For preventing the hollow particles from being crushed, and for solving the problems with the invention, the inventors have investigated various latexes and, as a result, have found that when the styrene-butadiene latex having Tg of from 30 to 85° C. is used in the heat-insulating layer in combination with hollow particles and gelatin, then the hollow particles are prevented from being crushed and the problems with the invention can be thereby solved. Specifically, in case where Tg of the styrene-butadiene latex is lower than 30° C., then not only the trouble of hollow particle crushing during drying the coating film but also the problems with the invention could not be solved.

Further, the inventors have found that the crushing of hollow particles occurs not only during drying the coating film but also during storage of the thermal transfer image-receiving sheet, as a roll. The thermal transfer image-receiving sheet is supplied as a roll product in many cases, and the inside part of the roll is readily pressurized. In case where the support expands depending on the environmental condition, the surface pressure to be given to the heat-insulating layer increases and therefore, when the hollow particles are thereby crushed, then the transfer performance of the sheet may be worsened. When Tg of the styrene-butadiene latex is too high, then the hollow particles may be prevented from being crushed, but the layer is brittle, and therefore, when pressure is given to the layer, the hollow particles are also crushed and the transfer density is thereby lowered. Accordingly, latex of which Tg is higher than 85° C., for example, a polystyrene latex (having Tg of 100° C.) is unfavorable.

For these reasons, the glass transition temperature (Tg) of the styrene-butadiene latex for use in the invention is defined to be from 30° C. to 85° C., preferably from 50° C. to 85° C., more preferably from 50° C. to 80° C., most preferably from 50° C. to 70° C. The glass transition temperature (hereinafter this may be referred to as Tg) of polybutadiene is about −90° C., and Tg of polystyrene is 100° C.; and Tg of the styrene-butadiene latex is in the middle between the two, and it is generally known that a polymer having a low Tg is flexible.

The glass transition temperature (Tg) may be measured according to the method stipulated in JIS K7121, using a differential scanning calorimeter.

Preferably, the number-average molecular weight of the styrene-butadiene latex is from 2,000 to 1,000,000, more preferably from 5,000 to 500,000.

When the styrene-butadiene latex is expressed by the molar ratio of the monomers constituting the recurring units therein, the ratio of styrene recurring unit/butadiene recurring unit is preferably from 99/1 to 40/60, more preferably from 95/5 to 50/50.

The styrene-butadiene latex includes those modified with a carboxyl group or the like.

The styrene-butadiene latex may contain any other comonomer than the styrene and butadiene recurring units, and for example, it may be copolymerized with acrylonitrile, acrylic acid, methacrylic acid, alkyl acrylate or alkyl methacrylate such as methyl methacrylate or ethyl acrylate, or the like. In case where the styrene-butadiene latex contains any other recurring unit than styrene and butadiene, preferably, the total of the styrene recurring unit and the butadiene recurring unit therein is at least 50% by mass.

The styrene-butadiene latex may be a random copolymer or a block copolymer. The styrene-butadiene latex may be a linear polymer or a branched polymer, or may have a crosslinked structure.

Preferably, the mean particle size of the styrene-butadiene latex is from 50 nm to 500 nm, more preferably from 50 to 300 nm.

As the styrene-butadiene latex, usable are commercial products, for example, Nipol LX433C, 2507H, LX407BP6, V1004 (by Nippon Zeon), Nalstar SR-115, SR-143 (by Nippon A & L), PCL0602 (by JSR).

In the invention, the ratio by mass of the solid content (a) of the gelatin to the solid content (b) of the latex in the heat-insulating layer (solid content by mass of gelatin/solid content by mass of styrene-butadiene latex, or that is, (a)/(b)) is preferably from 30/70 to 70/30, more preferably from 40/60 to 60/40.

When the sum of the solid content by mass of gelatin and that of styrene-butadiene latex in the heat-insulating layer is represented by A, and when the solid content by mass of the hollow particles therein is by B, then B/A is preferably from 30/70 to 70/30, more preferably from 40/60 to 60/40. In case where the layer contains any other water soluble polymer than gelatin, the solid content by mass thereof is added to A. When A is not too large, then the hollowness in the heat-insulating layer may be kept fully large and therefore the layer can readily secure heat insulation; and when A is not too small, then the film is not brittle.

Preferably, the thickness of the heat-insulating layer is from 5 to 40 μm, more preferably from 10 to 30 μm. When the thickness is too small, then the layer could hardly secure the intended heat insulation; but when too large, the production load to gel the coating liquid and to dry the coating layer may be large.

<Receiving Layer>

The image-receiving sheet of the invention has at least one receiving layer that contains at least a thermoplastic receiving polymer capable of receiving a dye. The receiving layer acts to receive the dye transferred from a thermal transfer sheet and to keep the formed image.

(Polymer Latex)

In the invention, the receiving layer preferably contains a polymer latex, an aqueous dispersion emulsion with a polymer finely dispersed therein and/or a water-soluble polymer, more preferably contains a polymer latex or a water-soluble polymer, for which, even more preferably, a polymer latex dispersed in a water-soluble dispersant is used.

The receiving layer may additionally contain a polymer latex having any other function, for example, for the purpose of regulating the elastic modulus of the film, in addition to the polymer latex serving as a receiving polymer to receive the dye transferred from a thermal transfer sheet in thermal transferring to form a recorded image.

Preferably, the mean particle size of the dispersion particles of the polymer latex for use in the receiving layer is from 1 to 50000 nm, more preferably from 5 to 1000 nm.

Examples of the thermoplastic resin for use for the polymer latex to be in the receiving layer in the invention include polycarbonate, polyester, polyacrylate, vinyl chloride copolymer, polyurethane, styrene-acrylonitrile copolymer, polycaprolactone, etc.

Of those, preferred are polycarbonate, polyester, polyacrylate and vinyl chloride copolymer; more preferred are polyester and vinyl chloride copolymer; and most preferred is vinyl chloride copolymer.

In this description, the vinyl chloride copolymer is a copolymer comprising at least vinyl chloride as the monomer and copolymerized with any other monomer. For example, this includes vinyl chloride/vinyl acetate copolymer, vinyl chloride/acrylate copolymer, vinyl chloride/methacrylate copolymer, vinyl chloride/vinyl acetate/acrylate copolymer, vinyl chloride/acrylate/ethylene copolymer. The copolymer may be a binary copolymer or a ternary copolymer, in which the monomers may be distributed irregularly or may be block-copolymerized.

To the copolymer, any auxiliary comonomer may be added, for example, selected from vinyl alcohol derivatives, maleic acid derivatives, vinyl ether derivatives, etc.

Preferably, the vinyl chloride content in the vinyl chloride copolymer is at least 50 mol %, and the content of the auxiliary comonomer of maleic acid derivatives, vinyl ether derivatives or the like therein is preferably at most 10 mol %.

In the invention, the polymer latex may be in the receiving layer either singly or as a mixture thereof. The polymer latex to be in the receiving layer may have a uniform structure or a core/shell structure, in which the resins constituting the core and the shell may have a different glass transition temperature.

In the invention, the glass transition temperature (Tg) of the polymer latex for use in the receiving layer is preferably from −30° C. to 100° C., more preferably from 0° C. to 90° C., even more preferably from 20° C. to 90° C., still more preferably from 40° C. to 90° C.

In case where the glass transition temperature (Tg) could not be measured, it may be computed according to the following formula:

$$1/Tg=\Sigma(Xi/Tgi)$$

In this, the polymer is considered to be formed through copolymerization of n's monomers of from i=1 to n. Xi means the mass fraction of the i'th monomer (ΣXi=1); and Tgi means the glass transition temperature (absolute temperature) of the homopolymer of i'th monomer. Σ is the sum of i=1 to n. For the glass transition temperature (Tgi) of the homopolymer of each monomer, the data shown in "Polymer Handbook (3rd Edition)" (written by J. Brandrup, E. H. Immergut (Wiley-Interscience, 1989)) may be employable herein.

The polymer concentration in the polymer latex preferred for use in the invention is preferably from 10 to 70% by mass relative to the latex liquid, more preferably from 20 to 60% by mass. Regarding the total amount of the polymer latex in the receiving layer, the solid content of the polymer latex is preferably from 50 to 98% by mass of all the polymer in the receiving layer, more preferably from 70 to 95% by mass.

Preferred embodiments of the polymer latex include acrylic polymers, polyesters, rubbers (e.g., SBR resin), polyurethanes, polyvinyl chloride copolymers including vinyl chloride-vinyl acetate copolymer, vinyl chloride-acrylate copolymer, vinyl chloride-methacrylate copolymer, etc., polyvinyl acetate copolymers including ethylene-vinyl acetate copolymer, etc., polyolefins, etc. The polymer latex may be a linear, polymer, or a branched polymer or a crosslinked polymer, or a homopolymer of single monomer alone, or a copolymer of two or more monomers. The copolymer may be a random copolymer or a block copolymer. The number-average molecular weight of the polymer is preferably from 5,000 to 1,000,000, more preferably from 10,000 to 50,000.

The polymer latex is preferably any one or a combination of polyester latex and vinyl chloride copolymer latex such as vinyl chloride/acrylic compound copolymer latex, vinyl chloride/vinyl acetate copolymer latex, vinyl chloride/vinyl acetate/acrylic compound copolymer latex, etc.

The vinyl chloride copolymer latex includes, for example, Vinybran 240, Vinybran 270, Vinybran 276, Vinybran 277, Vinybran 375, Vinybran 380, Vinybran 386, Vinybran 410, Vinybran 430, Vinybran 432, Vinybran 550, Vinybran 601, Vinybran 602, Vinybran 609, Vinybran 619, Vinybran 680, Vinybran 680S, Vinybran 681N, Vinybran 683, Vinybran 685R, Vinybran 690, Vinybran 860, Vinybran 863, Vinybran 685, Vinybran 867, Vinybran 900, Vinybran 938, Vinybran 950 (all by Nisshin Chemical Industry); SE1320 and S-830 (both by Sumitomo Chemtec); and these are preferably used as the polymer latex in the invention.

As the other polymer latex than the vinyl chloride copolymer latex, herein usable is a polyester polymer latex, including, for example, Vylonal MD1200, Vylonal MD1220, Vylonal MD1245, Vylonal MD1250, Vylonal MD1500, Vylonal MD1930, Vylonal MD1985 (all by Toyobo).

Of those, most preferred is vinyl chloride copolymer latex such as vinyl chloride/acrylic compound copolymer latex, vinyl chloride/vinyl acetate copolymer latex, vinyl chloride/vinyl acetate/acrylic compound copolymer latex.

(Water-Soluble Polymer)

In the invention, the receiving layer preferably contains a water-soluble polymer in addition to the polymer latex. When the layer contains a polymer latex and a water-soluble polymer, the water-soluble polymer hardly miscible with dye may exist among the polymer latex and therefore the dye fixed to the polymer latex can be prevented from diffusing away, and as a result, the change in the sharpness of the receiving layer with time may be reduced and the transferred image changes little with time, or that is, the layer may form a recorded image changing little with time.

In the thermal transfer image-receiving sheet of the invention, the receiving layer may contain a water-soluble polymer, and for the water-soluble polymer in the layer, preferred are gelatin, polyvinyl alcohol, polyvinylpyrrolidone, polyvinylpyrrolidone copolymer. These water-soluble polymers are effective for preventing the receiving layer from cracking in dry, and when the polymer is not too much in the layer, then dye transfer thereto from an ink sheet is good, and the transfer density is good.

The amount of the water-soluble polymer to be in the receiving layer is preferably from 0.1 to 10% by mass relative to the mass of the total solid content of the layer, more preferably from 0.5 to 5% by mass.

(Release Agent)

The receiving layer may contain release agent, UV absorbent, surfactant, preservative, lubricant, antioxidant, filming promoter, hardener and other additives. Above all, the receiving layer preferably contains a release agent.

Release Agent:

Preferably, the receiving layer in the invention contains a release agent. The release agent may be any ordinary release agent known in the art, including, for example, solid wax such as polyethylene wax, paraffin wax, fatty acid ester wax, amide wax, etc.; as well as silicone oil, phosphate compound, fluorine-containing surfactant, silicone surfactant, etc. Preferred for use herein is silicone oil, and more preferred is polyether-modified silicone oil.

The polyether-modified silicone oil not only secures the releasability between the thermal transfer sheet and the thermal transfer image-receiving sheet in image printing but also prevents the fusion of the polymer latex particles in the receiving layer, and is therefore effective for preventing the layer from cracking in dry.

In the invention, the polyether-modified silicone oil is preferably liquid at 25° C.

In the invention, the polyether-modified silicone oil is preferably non-reactive, more preferably not containing an epoxy group.

The polyester-modified silicone oil preferred for use in the invention includes a semiterminal-modified compound represented by the following formula (1), a both-terminal-modified compound represented by the following formula (2), a side chain-modified compound represented by the following formula (3), and a main chain-copolymerized compound represented by the following formula (4); and these are preferred for use in the invention.

Formula (1)

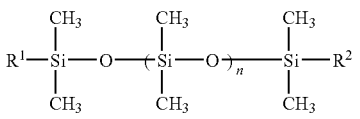

Formula (2)

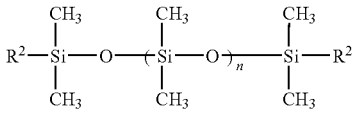

-continued

Formula (3)

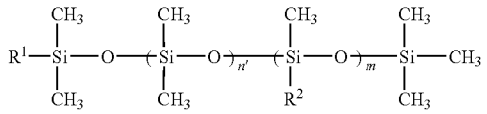

Formula (4)

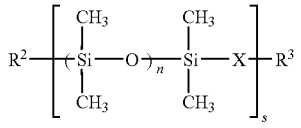

In formulae (1) to (4), $R^1$ represents an alkyl group; $R^2$ represents —Y—$(C_2H_4O)_a$—$(C_3H_6O)_b$—$R^4$; $R^3$ represents a hydrogen atom, an acyl group having at least one acyl moiety, an at least monovalent alkyl group, an at least monovalent cycloalkyl group, or an at least monovalent aryl group; $R^4$ independently represents a hydrogen atom, an acyl group, an alkyl group, a cycloalkyl group or an aryl group; Y represents a single bond or a divalent linking group; X represents a divalent linking group; n indicates a positive number; n' indicates 0 or a positive integer; m indicates 0 or a positive number; s indicates a positive number; a and b each independently indicate 0 or a positive number, but a and b are not 0 at the same time; and n' and m are not 0 at the same time.

The alkyl group for $R^1$ may have a substituent. The alkyl group for $R^1$ preferably has from 1 to 20 carbon atoms, more preferably from 1 to 8 carbon atoms, even more preferably from 1 to 4 carbon atoms. The alkyl group is preferably an unsubstituted alkyl group rather than a substituted alkyl group. Above all, preferred is a methyl group or an ethyl group; and most preferred is a methyl group.

Of the acyl group having at least one acyl moiety for $R^3$, the acyl group having one acyl moiety includes, for example, an acetyl group, a propionyl group, a butyryl group, a benzoyl group; the acyl group having two acyl moieties includes, for example, an oxalyl group, a malonyl group, a succinoyl group, maleoyl group, terephthaloyl group; the acyl group having three acyl moieties includes, for example, a 1,2,3-propanetricarbonyl group. The acyl group preferably has from 2 to 20 carbon atoms, more preferably from 2 to 10 carbon atoms.

Of the at least monovalent alkyl group for $R^3$, the monovalent alkyl group includes, for example, a methyl group, an ethyl group, a propyl group, an isopropyl group, a butyl group a tert-butyl group; the divalent alkyl group includes, for example, a methylene group, an ethylene group, a propylene group; the trivalent alkyl group includes, for example, a 1,2,3-propane-triyl group; the tetravalent alkyl group includes, for example, a 1,2,2,3-propane-tetrayl group. The alkyl preferably has from 1 to 20 carbon atoms, more preferably from 1 to 10 carbon atoms.

Of the at least monovalent cycloalkyl group for $R^3$, the monovalent cycloalkyl group includes, for example, a cyclopentyl group, a cyclohexyl group; the divalent cycloalkyl group includes, for example, a 1,3-cyclopentylene group, a 1,4-cyclopentylene group; the trivalent cycloalkyl group includes, for example, a 1,3,5-cyclohexane-triyl group. The cyclohexyl group preferably has from 5 to 10 carbon atoms.

Of the at least monovalent aryl group for $R^3$, the monovalent aryl group includes, for example, a phenyl group, a naphthyl group; the divalent aryl group includes, for example, a phenylene group; the trivalent aryl group includes, for example, a benzene-1,3,5-triyl group. The aryl moiety of the aryl group is preferably a benzene ring.

Preferably, $R^3$ is a monovalent alkyl group.

The acyl group for $R^4$ preferably has at most 20 carbon atoms, more preferably at most 10 carbon atoms, even more preferably at most 5 carbon atoms; and most preferred is an acetyl group.

The alkyl group for $R^4$ may have a substituent. The alkyl group for $R^4$ preferably has from 1 to 20 carbon atoms, more preferably from 1 to 8 carbon atoms, even more preferably from 1 to 4 carbon atoms. $R^4$ is preferably an unsubstituted alkyl group rather than a substituted alkyl group. Above all, preferred is a methyl group or an ethyl group; and most preferred is a methyl group.

The cycloalkyl group for $R^4$ may have a substituent. Preferred is a cyclopentyl group or a cyclohexyl group; and more preferred is an unsubstituted cycloalkyl group.

The aryl group for $R^4$ may have a substituent, including a phenyl group and a naphthyl group. Preferred is a phenyl group. As the substituent, preferred are an alkyl group and a halogen atom; however, an unsubstituted phenyl group is the most preferred.

$R^4$ is preferably a hydrogen atom, an acyl group, an alkyl group or an aryl group, more preferably a hydrogen atom, an acyl group or an alkyl group, even more preferably an alkyl group.

The divalent linking group for X and Y are independently preferably an alkylene group or an alkyleneoxy group; and for example, the alkylene group includes a methylene group, an ethylene group and a propylene group, and the alkyleneoxy group includes —$CH_2CH_2O$—, —$CH(CH_3)CH_2O$—, —$CH_2CH(CH_3)O$— and —$(CH_2)_3O$—; and these are preferred. The divalent linking group preferably has from 1 to 4 carbon atoms, more preferably 2 or 3 carbon atoms.

X and Y are preferably a single bond or the above-mentioned preferred divalent linking group.

a and b are independently preferably 0 or an integer of 1 or more, more preferably from 0 to 500, even more preferably from 0 to 200.

n is preferably from 1 to 1000; n' and m each are preferably from 0 to 1000.

s is preferably from 1 to 10, more preferably from 1 to 6, even more preferably from 1 to 4.

Of the polyether-modified silicone oils of formulae (1) to (4), preferred are those of formulae (2) to (4), more preferred are those of formulae (2) and (3), and most preferred are those of formula (3).

In the invention, the polyether-modified silicone oil preferably has an HLB value (hydrophile-lipophile balance) of from 5 to 9, more preferably from 5 to 7. When the HLB value is too low, then the release agent, may separate and aggregate in the coating liquid, therefore causing surface defects of the coating layer. When the HLB value is too high, then the release effect of the agent and the orientation effect on the surface of latex particles thereof may be insufficient, or that is, the release agent could not sufficiently exhibit its effect.

In the invention, the HLB value is computed according to the computational formula defined by the following formula, based on the Griffin method (Nishi, Imai & Kasai's "Handbook for Surfactant" published by Sangyo Tosho, 1960).

$$HLB=20\times Mw/M$$

wherein M means the molecular weight, and Mw means the formula weight (molecular weight) of the hydrophilic moiety. In this connection, M=Mw+Mo, in which Mo is the formula weight (molecular weight) of the oleophilic moiety.

Specific examples of the polyether-modified silicone oil preferred for use in the invention include Shin-etsu Chemical's KF-351A, KF-352A, KF-353, KF-354L, KF-355A, KF-615A, KF-945, KF-640, KF-642, KF-643, KF-6020, KF-6011, KF-6012, KF-6015, KF-6017, X-22-4515, X-22-6191; Toray Dow Corning's SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001, L-7002 (all trade names).

The polyether-modified silicone oil preferred for use in the invention can be readily produced, for example, according to the methods described in JP-A 2002-179797, 2008-1896, 2008-1897, or according to methods similar thereto.

In the invention, polyether-modified silicone oils can be used either singly or as combined. In the invention, any other release agent may be used in combination with the polyether-modified silicone oil.

The amount of the polyether-modified silicone oil to be added to the receiving layer is preferably from 1% by mass to 20% by mass relative to the total polymer latex in the layer, more preferably from 1% by mass to 10% by mass.

(Constitution of Receiving Layer)

The coating amount of the receiving layer is preferably from 0.5 to 10 g/m$^2$ (as the solid content—unless otherwise specifically indicated, the coating amount in the invention is in terms of the solid content of the coating matter).

Preferably, the thickness of the receiving layer is from 1 to 20 μm.

<Interlayer>

In addition to the heat-insulating layer, an interlayer may be provided between the receiving layer and the support. The interlayer may be any conventional known one having a function of white background regulation, static charge prevention, adhesiveness, cushionability, smoothness, barrier capability or the like. The position of the interlayer is not specifically defined. In case where the interlayer has a function of cushionability, smoothness or barrier capability, it is effectively provided between the receiving layer and the heat-insulating layer.

<Support>

The support for use in the thermal transfer image-receiving sheet of the invention may be any conventional known one. Preferred is a waterproof support. When a waterproof support is used, water penetration into the support may be prevented, and therefore the receiving layer can be protected from degradation with time. The waterproof support includes, for example, coated paper, laminate paper, synthetic paper. Above all, preferred is laminate paper.

<Curling Preventing Layer>

Preferably but if desired, a curling preventing layer may be provided in the thermal transfer image-receiving sheet of the invention. For the curling preventing layer, usable is a polyethylene laminate, a polypropylene laminate or the like. Concretely, for example, the curling preventing layer may be provided in the same manner as in JP-A 61-110135, 6-202295.

<Writing Layer/Antistatic Layer>

If desired, a writing layer and an antistatic layer may be provided in the thermal transfer image-receiving sheet of the invention. An inorganic oxide colloid, an ionic polymer or the like may be used in forming the writing layer and the antistatic layer. As the antistatic agent, for example, usable are cationic antistatic agents such as quaternary ammonium salts, polyamine derivatives, etc.; anionic antistatic agents such as alkyl phosphates, etc.; nonionic antistatic agents such as fatty acid esters, etc. Concretely, for example, the layers may be formed in the same manner as in Japanese Patent 3585585.

<Additives>

If desired, additives may be added to any other layer than the receiving layer in the thermal transfer image-receiving sheet of the invention. The additives include UV absorbent, surfactant, preservative, filming promoter, hardener, mat agent (including lubricant), antioxidant, etc., in addition to the release agent mentioned above.

UV Absorbent:

A UV absorbent may be added to the thermal transfer image-receiving sheet of the invention. As the UV absorbent, usable is any known inorganic UV absorbent or organic UV absorbent. The organic UV absorbent includes salicylate-based, benzophenone-based, benzotriazole-based, triazine-based, substituted acrylonitrile-based, or hindered amine-based non-reactive UV absorbents, and those derived from such non-reactive UV absorbents by introducing thereinto an addition-polymerizing double bond-having group such as a vinyl group, an acryloyl group or a methacryloyl group, or an alcoholic hydroxyl group, an amino group, a carboxyl group, an epoxy group, an isocyanate group or the like, or by copolymerizing or grafting a thermoplastic resin such as an acrylic resin with the UV absorbent. Disclosed is a method of dissolving a UV absorbent in a resin monomer or oligomer followed by polymerizing the monomer or oligomer (JP-A 2006-21333), and the UV-shielding resins thus produced are also usable herein. In this case, the UV absorbent may be a non-reactive one.

Of such UV absorbents, especially preferred are benzophenone-based, benzotriazole-based or triazine based UV absorbents. Preferably, the UV absorbents are combined for use herein in such a manner that the combined mixture can cover the effective UV absorption wavelength range in accordance with the characteristics of the dye to be used for image formation. Preferably, non-reactive UV absorbents having different structures are combined so that the UV absorbents used in the thermal transfer sheet do not precipitate out.

UV absorbents usable herein are available as commercial products, such as Tinuvin P (by Ciba-Geigy), JF-77 (by Johoku Chemical), Seesorb 701 (by Shiraishi Calcium), Sumisorb 200 (by Sumitomo Chemical), Biosorb 520 (by Kyodo Chemical), Adekastab LA-32 (by Adeka), etc.

Surfactant:

Surfactant may be added to the constitutive layers of the thermal transfer image-receiving sheet of the invention. Preferably, surfactant is added to the receiving layer and the interlayer.

The amount of the surfactant to be added is preferably from 0.01 to 5% by mass relative to the total solid content of the coating matter, more preferably from 0.01 to 1% by mass, even more preferably from 0.02 to 0.2% by mass.

Various anionic, nonionic and cationic surfactants are known. Any known surfactants are usable in the invention; and for example, those introduced by "Functional Surfactants" by Mitsuo Tsunoda, August 2000, Chap. 6 may be used. Above all, preferred are anionic fluorine-containing surfactants.

Preservative:

The thermal transfer image-receiving sheet of the invention may contain a preservative. The preservative to be added to the thermal transfer image-receiving sheet of the invention is not specifically defined. For example, herein usable are those described in "Antiseptic Antifungal Handbook" by Hiroshi Horiguchi, Giho-do Publishing (1986); "Antibacterial and Antifungal Chemistry" by Sankyo Publishing (1986); Encyclopedia of Antibacterials and Antifungals" by the Society of Antibacterial and Antifungal Agents of Japan (1986), etc. Concretely, there are mentioned imidazole derivatives, sodium dehydroacetate, 4-isothiazolin-3-one derivatives, benzoisothiazolin-3-one, benzotriazole derivatives, amidine-guanidine derivatives, quaternary ammonium salts, pyrrolidine, quinoline and guanidine derivatives, diazine and triazole derivatives, oxazole and oxazine derivatives, 2-mercaptopyridine-N-oxide and its salts, etc. Of those, preferred are 4-isothiazolin-3-one derivatives and benzoisothiazolin-3-one.

Filming Promoter:

Preferably, a high-boiling-point solvent is added to the thermal transfer image-receiving sheet of the invention. The high-boiling-point solvent is an organic compound (generally an organic solvent) that functions as a filming promoter or a plasticizer and lowers the lowermost filming temperature of polymer latex, and is described in Soichi Muroi' "Chemistry of Synthetic Latex" by Kobunshi Kanko-kai (1970). Examples of the high-boiling-point solvent (filming promoter) are the following:

Z-1: benzyl alcohols

Z-2: 2,2,4-trimethylpentanediol 1,3-monoisobutyrates

Z-3: 2-diethylaminoethanols

Z-4: diethylene glycols

When the high-boiling-point solvent is added, then images may be blurred and the solvent may be often unfavorable in practical use; however, when the solid content of the solvent in the coating film is at most 1%, then it may cause no problem to the performance.

Hardener:

A hardener may be added to the thermal transfer image-receiving sheet of the invention. It may be added to the coating layer (e.g., receiving layer, heat-insulating layer, undercoat layer) of the sheet.

As the hardener for use in the invention, preferred are H-1, 4, 6, 8, 14 on page 17 of JP-A 1-214845; compounds (H-1 to 54) of formulae (VII) to (XII) in columns 13 to 23 of U.S. Pat. No. 4,618,573; compounds (H-1 to 76), especially H-14, of formula (6) in the right lower part of page 8 of JP-A 2-214852; and compounds as claimed in claim 1 in U.S. Pat. No. 3,325,287. Examples of the hardener are shown in U.S. Pat. No. 4,678,739, column 41; U.S. Pat. No. 4,791,042; JP-A 59-116655, 62-245261, 61-18942, 4-218044. More concretely, there are mentioned aldehyde-type hardeners (e.g., formaldehyde), aziridine-type hardeners, epoxy-type hardeners, vinylsulfone-type hardeners (e.g., N,N'-ethylenebis(vinylsulfonylacetamide)ethane), N-methylol-type hardeners (e.g., dimethylolurea), boric acid, metaboric acid or polymer hardeners (e.g., compounds described in JP-A 62-234157). Preferred are vinylsulfone-type hardeners and chlorotriazines.

Mat Agent:

A mat agent may be added to the thermal transfer image-receiving sheet of the invention for prevention of blocking, for impartation of releasability and for impartation of lubricity. The mat agent may be added to the surface of the thermal transfer image-receiving sheet on which the receiving layer is formed, or to the surface thereof opposite to the surface on which the receiving layer is formed, or to the two surfaces thereof.

The mat agent generally comprises fine particles of an organic compound or an inorganic compound insoluble in water. From the viewpoint of the dispersibility, in the invention, preferred is use of fine particles containing an organic compound. Containing an organic compound, the particles may be any of organic compound particles of an organic compound alone or organic/inorganic composite particles containing not only an organic compound but also an inorganic compound. Examples of the mat agent usable herein are described in U.S. Pat. Nos. 1,939,213, 2,701,245, 2,322,037, 3,262,782, 3,539,344, 3,767,448.

[Method for Producing Thermal Transfer Image-Receiving Sheet]

A method for producing the thermal transfer-image receiving sheet of the invention is described below.

The method for producing the thermal transfer-image receiving sheet of the invention comprises simultaneously coating, on a support, a coating liquid for heat-insulating layer containing hollow polymer particles, gelatin and a latex having a glass transition temperature of from 30 to 85° C., and a coating liquid for receiving layer superimposed on the coating liquid for heat-insulating layer, in which the molecular chain of the polymer constituting the latex has a styrene recurring unit and a butadiene recurring unit.

Specifically, the thermal transfer image-receiving sheet of the invention is produced by the simultaneous multilayer coating of at least one receiving layer and at least one heat-insulating layer on a support.

The simultaneous multilayer coating is preferably water-based coating. "Water-based" as referred to herein means that water accounts for at least 60% by mass of the solvent (dispersant) of the coating liquid. The other ingredient than water in the coating liquid may be a water-miscible organic solvent such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, oxyethylene phenyl ether, etc.

In case where a multilayer-structured image-receiving sheet is produced, in which plural layers having different functions (foam layer, heat-insulating layer, interlayer, receiving layer, etc.) are formed on a support, there are known a method of applying the coating liquids sequentially to the support, for example, as in JP-A 2004-106283, 2004-181888, 2004-345267; and a method of sticking together the layers previously formed on the individual supports. On the other hand, in the field of photography, for example, a technique of simultaneous multilayer coating is known for greatly enhancing the producibility. For example, there are known a slide coating method and a curtain coating method as in U.S. Pat. Nos. 2,761,791, 2,681,234, 3,508,974, 4,457,256, 3,993,019, JP-A 63-54975, 61-278848, 55-86557, 52-31727, 55-142565, 50-43140, 63-80872, 54-54020, 5-104061, 5-127305, JP-B 49-7050; and Edgar B. Gutoff et al's "Coating and Drying Defects: Troubleshooting Operating Problems", John Wiley & Sons, 1995, pp. 101-103. According to these coating methods, plural coating liquids are simultaneously supplied to the coating apparatus to form plural layers at the same time.

The production method for the thermal transfer image-receiving sheet of the invention secures simultaneous multilayer coating and realizes high producibility, for which, therefore, preferred is slide coating or curtain coating. The thermal transfer image-receiving sheet of the invention can be produced in a mode of water-based coating to form at least one receiving layer and at least one heat-insulating layer on a support. In case where the sheet comprises a plurality of such layers, or in case where the sheet additionally has an interlayer and a subbing layer, preferably, all these layers are formed on a support according to the simultaneous multilayer coating method.

In the simultaneous multilayer coating, the viscosity and the surface tension of the coating liquids to form the constitutive layers must be controlled for formation of uniform coating films and for securing good coatability. The viscosity of the coating liquid may be readily controlled by using a known thickener or thinner within a range not having any influence on the other properties of the layers to be formed.

The surface tension of the coating liquid may be controlled by the use of a suitable surfactant.

In the invention, the plural layers comprise a resin as the main ingredient. Preferably, the coating liquid for forming the layer is a polymer latex. The solid content of the resin latex in the coating liquid is preferably within a range of from 5 to 80%, more preferably from 20 to 60%. Preferably, the mean particle size of the resin to be in the polymer latex is at most 5 μm, more preferably at most 1 μm. If desired, the polymer latex may contain any known additive such as surfactant, dispersant, binder resin, etc.

Preferably, the temperature of the coating liquid to form the layer is from 25° C. to 60° C., more preferably from 30° C. to 50° C.

In the invention, the coating amount of the coating liquid to form one layer of a multilayer structure is preferably from 1 $g/m^2$ to 500 $g/m^2$. The number of the layers constituting the multilayer structure may be 2 or more. Preferably, the receiving layer is provided as the remotest layer from the support.

In the drying zone, the film is dried in a constant drying period in which the drying rate is constant and the material temperature and the wet-bulb temperature are the same, and in a decreasing drying period in which the drying rate is decreased and the material temperature is elevated. In the constant drying period, external heat given to the film is all used for evaporating water. In the decreasing drying period, water dispersion inside the material is rate-limiting, then the drying rate is decreased owing to the recession of the evaporation surface, and the given heat is consumed for elevation of the material temperature.

In the setting zone and the drying zone, moisture transfer occurs between the coating films and between the support and the coating films, and the coating films are solidified through cooling and moisture evaporation. Accordingly, the history of film surface temperature and drying time during the drying has a great influence on the quality and the performance of the products, and the condition must be set up depending on the required quality.

Preferably, the temperature in the setting zone is not higher than 15° C., the period of the cooling time is from 5 seconds to less than 30 seconds. When the period of less than 5 seconds, then the viscosity of the coating liquid could not be fully increased and the surface condition of the film may be worsened in the subsequent drying process. When the period of the cooling step takes 30 seconds or more, then a lot of time may be taken for moisture removal in the subsequent drying step, and the producibility may be thereby lowered.

After the cooling step at 15° C. or lower, the film is dried in an environment at a temperature higher than 15° C. In this process in the invention, preferably, the moisture evaporation from the superimposed coating film is so controlled that the water content of the coating film could be at least 60% of the water content of the coating film immediately after coating in 1 $m^2$, within 30 seconds after the end of the cooling step. The water content of the coating film immediately after coating in 1 $m^2$ is equal to the water content in the coating liquid prepared just before coating. When the moisture evaporation is not too small, then the water content of the coating layer is not too large and the surface condition can be kept good. On the other hand, in case where the moisture evaporation is controlled to be at least 60%, when the drying temperature is not too high over 50° C., then the moisture evaporation may not be too rapid and therefore, the dried film is not cracked and the surface condition thereof can be kept good. Accordingly, the drying temperature is preferably not higher than 50° C.

The moisture evaporation is defined as follows: After coating, the thermal transfer image-receiving sheet is dried in an environment at 110° C. for 1 hour, and the moisture mass in the thus-dried sheet is defined as 100% evaporation, and the difference in mass is computed.

After dried, the coated product is controlled to have a predetermined moisture content and then wound up. The moisture content and the temperature of the wound roll during storage may have influence on the hardening of the film, and therefore, a suitable moisture regulating condition must be set for controlling the water content of the film in the step of winding it.

In general, the hardening reaction rapidly goes on under a high-temperature high-humidity condition. However, when the water content is too high, the coated films may adhere to each other and there may occur some problem in the quality of products. Accordingly, the water content (moisture-regulating condition) in winding and storage must be suitably set in accordance with the quality of the products.

Typical drying systems are an air-loop system and an air-floating system. In the air-loop system, a drying air stream is applied to the coated product supported by rollers; and in the system, the duct may be disposed vertically or horizontally. In the system, the drying function and the transfer function are basically separated, and the latitude in the air flow is large. However, since the system requires many rollers, there may occur base transfer failures such as shifting, wrinkling, slipping, etc. In the air-floating system, the coated product is spirally wound around a cylindrical duct and transferred and dried while floated with drying air applied thereto, and the system does not basically require roller supporting (JP-B 43-20438). Apart from these, also employable is a transfer drying system of using upper and lower ducts installed therein. In general, this is better in point of the drying distribution but is poor in the floating capacity as compared with the air-floating system.

<Method of Image Formation>

In the image formation method of using the thermal transfer image-receiving sheet of the invention, the thermal transfer image-receiving sheet of the invention is kept in contact with a thermal transfer sheet in such a manner that the receiving layer of the former faces the dye layer (thermal transfer layer) of the latter, and thermal energy in accordance with the image signal from a thermal head is applied thereto for image formation.

Regarding the details of the method, for example, referred to are those of the method described in JP-A 2005-88545. In the invention, from the viewpoint of shortening the time to be taken before prints are provided to consumers, the printing time is preferably less than 15 seconds, more preferably from 3 to 12 seconds, even more preferably from 3 to 7 seconds.

For satisfying the above-mentioned printing time, the line speed in printing is preferably at most 2.0 msec/line, more preferably at most 1.5 msec/line, more preferably at most 0.73 msec/line, most preferably at most 0.65 msec/line. From the viewpoint of enhancing the transfer efficiency under high-speed processing condition, the ultimate temperature of the thermal head in printing is preferably from 180° C. to 450° C., more preferably from 200° C. to 450° C., even more preferably from 350° C. to 450° C.

The thermal transfer image-receiving sheet of the invention is applicable to printers, copiers and the like to be driven in a thermal transfer recording system. The means of imparting thermal energy in thermal transfer may be any conventional known means. For example, using a recording apparatus such as a thermal printer (e.g., Hitachi's trade name, Video Printer VY-100) or the like, the recording time may be controlled, and thermal energy on a level of from 5 to 100 $mJ/mm^2$ or so may be given to fully attain the intended object.

By suitably selecting the support in the thermal transfer image-receiving sheet for use in the invention, the invention is applicable to various applications of thermally-transferable sheet-fed or roll thermal transfer image-receiving sheets, cards, transparent sheets for manuscript formation, etc.

EXAMPLES

The invention is described more concretely with reference to the following Examples. In the following Examples, the material used, its amount and the ratio, the details of the treatment and the treatment process may be suitably modified or changed not overstepping the spirit and the scope of the invention. Accordingly, the invention should not be limitatively interpreted by the Examples mentioned below. In the following Examples, part and % are by mass, unless otherwise specifically indicated.

Production Example 1

(Production of Thermal Transfer Sheet)

A back layer coating liquid was applied to a support of 6.0-μm thick polyester film, of which one surface had been processed for easy adhesion, (Diafoil K200E-6F, trade name by Mitsubishi Polyester Film), on the other surface thereof opposite to the easy adhesion-processed surface, to be a coating amount as the solid content after dried of 1 g/m$^2$. After coated, this was cured by heat treatment at 60° C.

Coating liquids for yellow, magenta and cyan thermal transfer layers and transfer protective layer laminate (composed of release layer, protective layer and adhesive layer) mentioned below were applied to the side of the easy-adhesion layer of the polyester film prepared in the above, in a frame sequential mode, thereby producing a thermal transfer sheet. The coating amount as solid content of the individual dye layers was 0.8 g/m$_2$ each. The dry coating amount of the transfer protective layer laminate was as follows: The release layer was 0.3 g/m$^2$, the protective layer was 0.5 g/m$^2$, and the adhesive layer was 2.2 g/m$^2$.

Back Layer Coating Liquid:

| | |
|---|---|
| Acrylic polyol resin (Acrydic A-801, trade name by DIC) | 26.0 mas. pts. |
| Zinc stearate (SZ-2000, trade name by Sakai Chemical Industry) | 0.43 mas. pts. |
| Phosphate (Prisurf A217, trade name by Daiichi Kogyo Seiyaku) | 1.27 mas. pts. |
| Isocyanate (50% solution) (Burnock D-800, trade name by DIC) | 8.0 mas. pts. |
| Methyl ethyl ketone/toluene (2/1 by mass) | 64 mas. pts. |

Yellow Dye Layer Coating Liquid:

| | |
|---|---|
| Dye compound (Y-1) | 3.9 mas. pts. |
| Dye compound (Y-2) | 3.9 mas. pts. |
| Polyvinyl acetacetal resin (ESLEC KS-1, trade name by Sekisui Chemical Industry) | 6.1 mas. pts. |
| Polyvinyl butyral resin (Denkabutyral #6000-C, trade name by Denki Kagaku Kogyo) | 2.1 mas. pts. |
| Release agent (X-22-3000T, trade name by Shin-etsu Chemical Industry) | 0.05 mas. pts. |
| Release agent (TSF4701, trade name by Momentive Performance Materials Japan) | 0.03 mas. pts. |

-continued

| | |
|---|---|
| Mat agent (FLO-THENE UF, trade name by Sumitomo Seiko) | 0.15 mas. pts. |
| Methyl ethyl ketone/toluene (2/1 by mass) | 84 mas. pts. |

Y-1

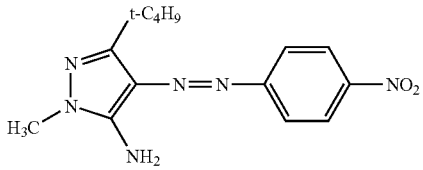

Y-2

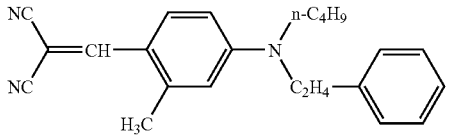

Magenta Dye Layer Coating Liquid:

| | |
|---|---|
| Dye compound (M-1) | 0.1 mas. pts. |
| Dye compound (M-2) | 0.7 mas. pts. |
| Dye compound (M-3) | 6.6 mas. pts. |
| Polyvinyl acetacetal resin (ESLEC KS-1, trade name by Sekisui Chemical Industry) | 8.0 mas. pts. |
| Polyvinyl butyral resin (Denkabutyral #6000-C, trade name by Denki Kagaku Kogyo) | 0.2 mas. pts. |
| Release agent (X-22-3000T, trade name by Shin-etsu Chemical Industry) | 0.05 mas. pts. |
| Release agent (TSF4701, trade name by Momentive Performance Materials Japan) | 0.03 mas. pts. |
| Mat agent (FLO-THENE UF, trade name by Sumitomo Seiko) | 0.15 mas. pts. |
| Methyl ethyl ketone/toluene (2/1 by mass) | 84 mas. pts. |

M-1

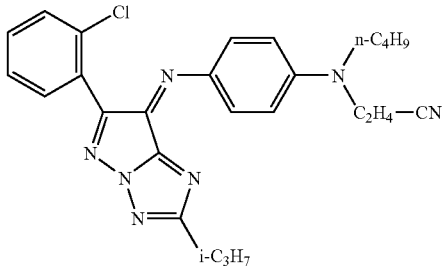

M-2

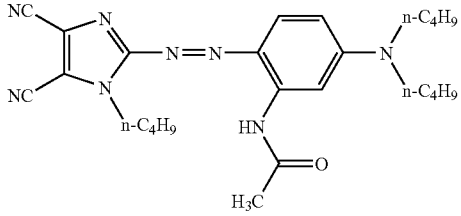

M-3

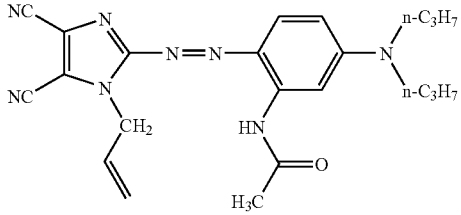

Cyan Dye Layer Coating Liquid:

| | |
|---|---|
| Dye compound (C-1) | 1.2 mas. pts. |
| Dye compound (C-2) | 6.6 mas. pts. |
| Polyvinyl acetacetal resin (ESLEC KS-1, trade name by Sekisui Chemical Industry) | 7.4 mas. pts. |
| Polyvinyl butyral resin (Denkabutyral #6000-C, trade name by Denki Kagaku Kogyo) | 0.8 mas. pts. |
| Release agent (X-22-3000T, trade name by Shin-etsu Chemical Industry) | 0.05 mas. pts. |
| Release agent (TSF4701, trade name by Momentive Performance Materials Japan) | 0.03 mas. pts. |
| Mat agent (FLO-THENE UF, trade name by Sumitomo Seiko) | 0.15 mas. pts. |
| Methyl ethyl ketone/toluene (2/1 by mass) | 84 mas. pts. |

C-1

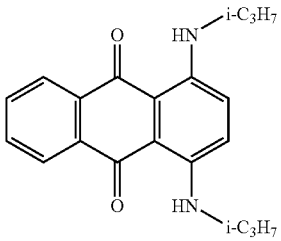

C-2

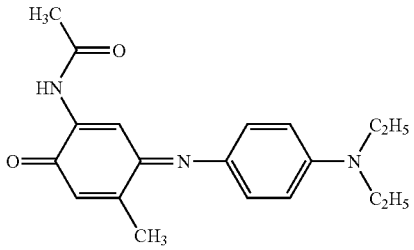

Release Layer Coating Liquid:

| | |
|---|---|
| Modified cellulose resin (L-30, trade name by Daicel Chemical) | 5.0 mas. pts. |
| Methyl ethyl ketone | 95.0 mas. pts. |
| Protective Layer Coating Liquid: | 30 mas. pts. |
| Acrylic resin (Dianal BR-100, trade name by Mitsubishi Rayon) | |
| Isopropanol | 70 mas. pts. |
| Adhesive Layer Coating Liquid: | 25 mas. pts. |
| Acrylic resin (Dianal BR-77, trade name by Mitsubishi Rayon) | |
| UV absorbent UV-1 mentioned below | 1 mas. pt. |
| UV absorbent UV-2 mentioned below | 2 mas. pts. |
| UV absorbent UV-3 mentioned below | 1 mas. pt. |
| UV absorbent UV-4 mentioned below | 1 mas. pt. |
| Silicone resin fine particles (Tospearl 120, trade name by Momentive Performance Materials Japan) | 0.05 mas. pts. |
| Methyl ethyl ketone/toluene (2/1 by mass) | 70 mas. pts. |

-continued (UV-1)

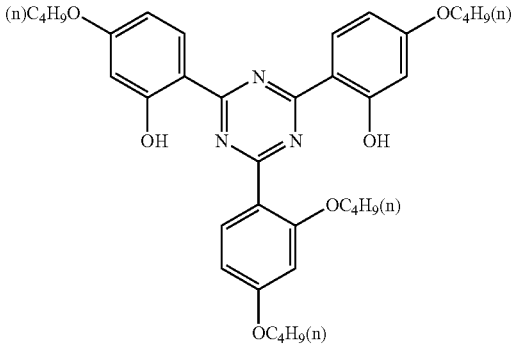

(UV-2)

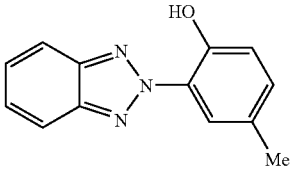

(UV-3)

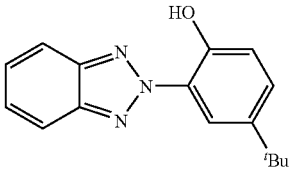

(UV-4)

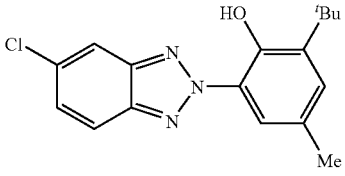

Comparative Example 1

(Production of Thermal Transfer Image-Receiving Sheet 1)

The surface of a paper support double-laminated with polyethylene was processed for corona discharge treatment, and then a sodium dodecylbenzenesulfonate-containing gelatin undercoat layer was formed on it. On this, a subbing layer, a heat-insulating layer, an interlayer and a receiving layer having the composition mentioned below were formed, as laminated in that order from the side of the support, according to the simultaneous multilayer coating method illustrated in FIG. 9 in U.S. Pat. No. 2,761,791. The solid content of each layer was as follows: The subbing layer was 3 g/m$^2$, the heat-insulating layer was 15 g/m$^2$, the interlayer was 2.5 g/m$^2$, and the receiving layer was 2.5 g/m$^2$.

Receiving Layer Coating Liquid 1:

| | |
|---|---|
| Vinyl chloride latex (Vinybran 900, trade name by Nisshin Chemical Industry, solid content 40%) | 20.0 mas. pts. |
| Vinyl chloride latex (Vinybran 690, trade name by Nisshin Chemical Industry, solid content 55%) | 20.0 mas. pts. |

-continued

| | |
|---|---|
| Gelatin (aqueous 10% solution) | 2.0 mas. pts. |
| Polyvinylpyrrolidone (K-90, trade name by ISP) | 0.5 mas. pts. |
| Polyether-modified silicone oil (L-7001, trade name by Toray Dow Corning Silicone, side-chain modified type, HLB = 5) | 1.0 mas. pts. |
| Surfactant F-1 mentioned below (aqueous 5% solution) | 1.5 mas. pts. |
| Surfactant F-2 mentioned below (aqueous 5% solution) | 5 mas. pts. |
| Water | 50.0 mas. pts. |

Interlayer Coating Liquid 1:

| | |
|---|---|
| Vinyl chloride latex (Vinybran 690, trade name by Nisshin Chemical Industry, solid content 55%) | 50.0 mas. pts. |
| Gelatin (aqueous 10% solution) | 30.0 mas. pts. |
| Water | 20.0 mas. pts. |

Heat-Insulating Layer Coating Liquid 1:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 50.0 mas. pts. |
| Water | 27.0 mas. pts. |

Subbing Layer Coating Liquid 1:

| | |
|---|---|
| Polyvinyl alcohol (Poval PVA205, trade name by Kuraray)] | 5.0 mas. pts. |
| Styrene-butadiene rubber latex (SN-307, trade name by Nippon A & L, having a solid content of 48%) | 60.0 mas. pts. |
| Water | 35.0 mas. pts. |

(F-1)

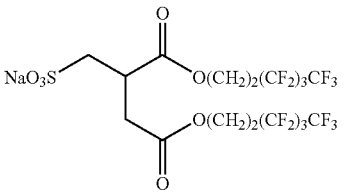

(F-2)

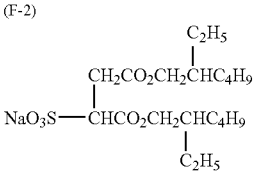

Comparative Examples 2 to 4, and Examples 1 to 5

(Production of Thermal Transfer Image-Receiving Sheets 2 to 9)

Thermal transfer image-receiving sheets 2 to 9 of Comparative Examples 2 to 4 and Examples 1 to 5 were produced in the same manner as that for the thermal transfer image-receiving sheet 1, for which, however, the heat-insulating layer coating liquid 1 was changed to any of the following heat-insulating layer coating liquids 2 to 9. The coating amount of the heat-insulating layer in these sheets was the same as that in the thermal transfer image-receiving sheet 1, or that is, the solid content in the layer was 15 g/m$^2$.

(Thermal Transfer Image-Receiving Sheet 2)

Heat-Insulating Layer Coating Liquid 2:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Modified styrene-butadiene latex (Nipol LX426, trade name by Nippon Zeon, having Tg of −39° C., a mean particle size of 120 nm, a solid content of 50%) | 5.0 mas. pts. |
| Water | 47.0 mas. pts. |

(Thermal Transfer Image-Receiving Sheet 3)

Heat-Insulating Layer Coating Liquid 3:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Modified styrene-butadiene latex (Nipol LX430, trade name by Nippon Zeon, having Tg of 12° C., a mean particle size of 150 nm, a solid content of 49%) | 5.1 mas. pts. |
| Water | 46.9 mas. pts. |

(Thermal Transfer Image-Receiving Sheet 4)

Heat-Insulating Layer Coating Liquid 4:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Carboxyl-modified styrene-methyl methacrylate-acrylonitrile-butadiene latex (SR-143, trade name by Nippon A & L, having Tg of 35° C., a mean particle size of 160 nm, a solid content of 48%) | 5.2 mas. pts. |
| Water | 46.8 mas. pts. |

(Thermal Transfer Image-Receiving Sheet 5)

Heat-Insulating Layer Coating Liquid 5:

| | |
|---|---|
| Acrylic hollow particles (Rohpake HP-1055, trade name by Rohm & Haas, having a mean | 20.0 mas. pts. |

-continued

| | |
|---|---|
| particle size of 1.0 μm, a solid content of 26.5%, and a degree of hollowness of 55%) | |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Modified styrene-butadiene latex (Nipol LX433C, trade name by Nippon Zeon, having Tg of 50° C., a mean particle size of 100 nm, a solid content of 50%) | 5.0 mas. pts. |
| Water | 47.0 mas. pts. |

(Thermal Transfer Image-Receiving Sheet 6)

Heat-Insulating Layer Coating Liquid 6:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Styrene-butadiene latex (Nipol 2507H, trade name by Nippon Zeon, having Tg of 58° C., a mean particle size of 250 nm, a solid content of 52%) | 4.8 mas. pts. |
| Water | 47.2 mas. pts. |

(Thermal Transfer Image-Receiving Sheet 7)

Heat-Insulating Layer Coating Liquid 7:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Styrene-butadiene latex (Nipol LX407BP6, trade name by Nippon Zeon, having Tg of 70° C., a solid content of 50%) | 5.0 mas. pts. |
| Water | 47.0 mas. pts. |

(Thermal Transfer Image-Receiving Sheet 8)

Heat-Insulating Layer Coating Liquid 8:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Styrene-butadiene latex (Nipol V1004, trade name by Nippon Zeon, having Tg of 80° C., a solid content of 50%) | 5.0 mas. pts. |
| Water | 47.0 mas. pts. |

(Thermal Transfer Image-Receiving Sheet 9)

Heat-Insulating Layer Coating Liquid 9:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 20.0 mas. pts. |
| Acrylic styrene hollow particles (Nipol MH5055, trade name by Nippon Zeon, having a mean particle size of 0.5 μm, a solid content of 30%, and a degree of hollowness of 55%) | 3.0 mas. pts. |
| Gelatin (aqueous 10% solution) | 25.0 mas. pts. |
| Polystyrene latex (Nipol LX303A, trade name by Nippon Zeon, having Tg of 100° C., a mean particle size of 160 nm, a solid content of 50%) | 5.0 mas. pts. |
| Water | 47.0 mas. pts. |

(Compression Pressing)

The thermal transfer image-receiving sheet was cut into square pieces (20 cm×20 cm), and 5 pieces were piled up and sandwiched between 0.5-cm thick rubber sheets to prepare a sample. Given a pressure of 0.4 MPa, the sample was kept in an environment of 25° C./55% for 10 days. Next, the third piece of the thus-pressed sample was taken out, and stuck to an unrolled printing paper so as to be charged in a printer.

On the other hand, the thermal transfer image-receiving sheet was cut into square pieces (20 cm×20 cm), and 5 pieces were piled up and sandwiched between 0.5-cm thick rubber sheets to prepare a sample. With no pressure given thereto, the sample was kept in an environment of 25° C./55% for 10 days. Next, the third piece of the non-pressed sample was taken out, and stuck to an unrolled printing paper so as to be charged in a printer.

(Image Formation)

For image formation, used was a printer, FUJIFILM's Thermal Photoprinter ASK-2000L (trade name). The thermal transfer sheet produced in Production Example 1 and the thermal transfer image-receiving sheet of Examples and Comparative Examples were worked so that they could be charged in the printer, and a black solid image of the highest density was outputted on the image-receiving sheet. The black solid image of the highest density was outputted both on the image-receiving sheet aged under no compression pressing and on the image-receiving sheet aged under compression pressing of Examples and Comparative Examples.

In many cases, a thermal transfer image-receiving sheet is provided as a roll product, and pressure is given to the inside part of the roll; and in case where the support swells depending on the environmental condition, the face pressure given to the heat-insulating layer is great. Accordingly, thermal transfer image-receiving sheets free from quality change when given pressure are preferred.

(Transfer Density)

The black solid image of the highest density formed on the image-receiving sheet aged under no compression pressing and on the image-receiving sheet aged under compression pressing was analyzed for the V density thereof, using Xrite 310 (trade name by Xrite). The density of the image formed on the thermal transfer image-receiving sheet 1 aged under no compression pressing was defined as 100; and the density of the other thermal transfer image-receiving sheets 2 to 9 was expressed as a relative value. The results are shown in Table 1 below.

TABLE 1

| Image-Receiving Sheet No. | Latex Tg | Transfer Density (no pressure given) | Transfer Density (pressure given) | Remarks |
|---|---|---|---|---|
| 1 | (no latex) | 100 | 84 | Comparative Example 1 |
| 2 | −39° C. | 90 | 88 | Comparative Example 2 |
| 3 | 12° C. | 98 | 93 | Comparative Example 3 |
| 4 | 35° C. | 143 | 138 | Example 1 |
| 5 | 50° C. | 169 | 164 | Example 2 |
| 6 | 58° C. | 170 | 164 | Example 3 |
| 7 | 70° C. | 168 | 161 | Example 4 |
| 8 | 80° C. | 164 | 152 | Example 5 |
| 9 | 100° C. | 145 | 106 | Comparative Example 4 |

As in Table 1, the transfer density did not increase in the image-receiving sheet 1 in which the heat-insulating layer contained only hollow particles and gelatin, and in the image-receiving sheet 2 in which the styrene-butadiene latex having a low glass transition temperature, as described in JP-A 2008-296528, was added to the heat-insulating layer. This is because, pressure was given to the heat-insulating layer owing to the drying shrinkage of the gelatin-containing coating film, and the hollow particles were crushed. As opposed to these, the image-receiving sheet 4 (product of the invention) in which a latex having a glass transition temperature of higher than 30° C. was used had a high transfer density; and the image-receiving sheets 5 to 8 (products of the invention) in which a latex having a glass transition temperature of higher than 50° C. had a higher transfer density, and yielded a better result.

On the other hand, the image-receiving sheet 9 in which a polystyrene latex having a glass transition temperature of 100° C. was used had a high transfer density when aged under no pressure; however, when aged under pressure, the transfer density of the sheet 9 greatly lowered, and this means that the transfer density stability of the sheet 9 is poor.

Regarding the image-receiving sheets 4 to 8 of the invention, the transfer density difference between those aged under pressure and those aged under no pressure was small, and this means that the transfer density on these sheets is stable and high.

Examples 11 to 16

In the thermal transfer image-receiving sheet 6 of Example 3, the solid ratio of gelatin to styrene-butadiene latex was 50/50. In the same manner as that for the thermal transfer image-receiving sheet 6 but modifying the coating liquid composition so as to change the ratio of these two to 20/80, 30/70, 40/60, 60/40, 70/30 or 80/20 while the total solid content of the two was kept constant, thermal transfer image-receiving sheets 11 to 16 of Examples 11 to 16 were produced. The coating amount of the heat-insulating layer was the same as in the thermal transfer image-receiving sheet 1, and the solid content in the layer was 15 g/m$^2$.

(Image Formation)

For image formation, used was a printer, FUJIFILM's Thermal Photoprinter ASK-2000L (trade name). The thermal transfer sheet and the thermal transfer image-receiving sheet were worked so that they could be charged in the printer, and a black solid image of the highest density and a line pattern image (composed of 30 black solid lines of 1 mm width×5 cm length aligned at intervals of 1 mm each) were outputted on the image-receiving sheet. The black solid image was outputted both on the image-receiving sheet aged under no compression pressing and on the image-receiving sheet aged under compression pressing, like in Example 3. The line pattern image was outputted on the image-receiving sheet aged under no compression pressing, and the image-printed sample was evaluated for the image storability thereon in the manner as mentioned below.

(Transfer Density)

In the same manner as in Example 3, samples of the thermal transfer image-receiving sheets 11 to 16 were aged under no compression pressing and under compression pressing, and processed for image formation thereon. The V density of the black solid image formed on each sample was measured with Xrite 310 (trade name by Xrite). The density of the image formed on the thermal transfer image-receiving sheet 1 aged under no compression pressing was defined as 100; and the density of the other thermal transfer image-receiving sheets 3 and 11 to 16 was expressed as a relative value. The results are shown in Table 2 below.

(Image Blurring Level after Storage)

A line pattern image was printed on the thermal transfer image-receiving sheets 1 and 3 of Comparative Examples 1 and 3 and on the thermal transfer image-receiving sheets of 6 and 11 to 16 of Examples 3 and 11 to 16 of the invention; and these printed samples were stored at 50° C./70% 3 months. After stored, the samples were checked visually for the line pattern blurring caused by dye diffusion in the image-receiving sheets, and evaluated according to the standards of the following 5 ranks.

5: No blurring was seen at all, as compared with the sample before storage.

4: Little blurring was seen, as compared with the sample before storage.

3: Some blurring was seen as compared with the sample before storage, but the lines were clearly differentiable from each other on a practicable level.

2: Blurring was noticeable as compared with the sample before storage, though the lines were differentiable from each other.

1: Blurring was great as compared with the sample before storage, and the lines were hardly differentiable from each other.

The results obtained from the above are shown in Table 2 below.

TABLE 2

| Image-Receiving Sheet No. | Tg of Latex in Heat-Insulating Layer | Ratio of Gelatin/Latex in Heat-Insulating Layer | Transfer Density (no pressure given) | Transfer Density (pressure given) | Blurring Level | Remarks |
|---|---|---|---|---|---|---|
| 1 | (no latex) | 100/0 | 100 | 84 | 1 | Comparative Example 1 |

TABLE 2-continued

| Image-Receiving Sheet No. | Tg of Latex in Heat-Insulating Layer | Ratio of Gelatin/Latex in Heat-Insulating Layer | Transfer Density (no pressure given) | Transfer Density (pressure given) | Blurring Level | Remarks |
|---|---|---|---|---|---|---|
| 3 | 12° C. | 50/50 | 98 | 93 | 1 | Comparative Example 3 |
| 6 | 58° C. | 50/50 | 170 | 164 | 5 | Example 3 |
| 11 | 58° C. | 20/80 | 167 | 161 | 3 | Example 11 |
| 12 | 58° C. | 30/70 | 170 | 163 | 4 | Example 12 |
| 13 | 58° C. | 40/60 | 169 | 163 | 5 | Example 13 |
| 14 | 58° C. | 60/40 | 168 | 163 | 5 | Example 14 |
| 15 | 58° C. | 70/30 | 165 | 169 | 4 | Example 15 |
| 16 | 58° C. | 80/20 | 153 | 145 | 3 | Example 16 |

Irrespective of pressure or no pressure given thereto, the thermal transfer image-receiving sheets 11 to 16 all had a high transfer density. Regarding the image blurring level, it is known that the samples in which the ratio of gelatin/styrene-butadiene latex in the heat-insulating layer was from 30/70 to 70/30 yielded a good result, and those in which the ratio was from 40/60 to 60/40 yielded a further better result.

Example 21

A thermal transfer image-receiving sheet 21 of Example 21 was produced in the same manner as that for the thermal transfer image-receiving sheet 6 of Example 3, for which, however, the heat-insulating layer coating liquid 6 for the sheet 6 was changed to the following upper heat-insulating layer coating liquid 21 and lower heat-insulating layer coating liquid 21 to form a two-layered heat-insulating layer. On a support, a subbing layer, a lower heat-insulating layer, an upper heat-insulating layer, an interlayer and a receiving layer were formed in that order by the simultaneous multilayer coating method. The solid coating amount was as follows: The subbing layer was 3 g/m$^2$, the lower heat-insulating layer was 7 g/m$^2$, the upper heat-insulating layer was 8 g/m$^2$, the interlayer was 2.5 g/m$^2$, the receiving layer was 2.5 g/m$^2$. The simultaneous multilayer coating method facilitates the production of the multilayer thermal transfer image-receiving sheet, not imparting any large load to the producibility.

(Thermal Transfer Image-Receiving Sheet 21)

Upper Heat-Insulating Layer Coating Liquid 21:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 23.0 mas. pts. |
| Gelatin (aqueous 10% solution) | 25.0 mas. pts. |
| Styrene-butadiene latex (Nipol 2507H, trade name by Nippon Zeon, having Tg of 58° C., a mean particle size of 250 nm, a solid content of 52%) | 4.8 mas. pts. |
| Water | 47.2 mas. pts. |

Lower Heat-Insulating Layer Coating Liquid 21:

| | |
|---|---|
| Acrylic hollow particles (Rohpake HP-1055, trade name by Rohm & Haas, having a mean particle size of 1.0 μm, a solid content of 26.5%, and a degree of hollowness of 55%) | 8.0 mas. pts. |

-continued

| | |
|---|---|
| Acrylic styrene hollow particles (Nipol MH5055, trade name by Nippon Zeon, having a mean particle size of 0.5 μm, a solid content of 30%, a degree of hollowness of 55%) | 20.0 mas. pts. |
| Gelatin (aqueous 10% solution) | 25.0 mas. pts. |
| Styrene-butadiene latex (Nipol 2507H, trade name by Nippon Zeon, having Tg of 58° C., a mean particle size of 250 nm, a solid content of 52%) | 4.8 mas. pts. |
| Water | 42.2 mas. pts. |

In the same manner as in Example 3, samples of the thermal transfer image-receiving sheet 21 were aged under no compression pressing and under compression pressing, and processed for image formation thereon. The V density of the black solid image formed on each sample was measured with Xrite 310 (trade name by Xrite). The image density of these samples was evaluated based on the density of the black solid image formed in Comparative Example 1 under no compression pressing. The transfer density of the black solid image formed on the thermal transfer image-receiving sheet 21 was 174 with no pressure given thereto, and was 168 with pressure given thereto. It is known that, as compared with the thermal transfer image-receiving sheet 6 of Example 3, the sheet 21 has further bettered transfer capability. For confirming the handlability thereof, the image-receiving sheets were rubbed with a nail on the surface to check as to whether or not and how the surface would yield. As a result, it has been known that the sheet 21 is more hardly scratched with a nail than the thermal transfer image-recording sheet 6 of Example 3.

Further, it has been confirmed that the images printed on the thermal transfer image-receiving sheet of the invention produced through the simultaneous multilayer coating are free from transfer defects such as white spots resulting from surface irregularities, and the sheet has good surface smoothness.

From the above, it is known that the thermal transfer image-receiving sheet of the invention, as produced through the simultaneous multilayer coating, is excellent in comprehensive transfer printability thereon with suppressing the increase in the load to producibility.

While the present invention has been described in detail and with reference to specific embodiments thereof, it will be apparent to one skilled in the art that various changes and modifications can be made therein without departing from the spirit and scope thereof.

The present disclosure relates to the subject matter contained in Japanese Patent Application No. 2009-080940, filed on Mar. 30, 2009, the contents of which are expressly incorporated herein by reference in their entirety. All the publications referred to in the present specification are also expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A thermal transfer image-receiving sheet having, on a support, at least one heat-insulating layer and at least one receiving layer on the heat-insulating layer, wherein:

the heat-insulating layer contains hollow polymeric particles, gelatin and a latex having a glass transition temperature of from 30 to 85° C., and the molecular chain of the polymer constituting the latex has a styrene recurring unit and a butadiene recurring unit.

2. The thermal transfer image-receiving sheet according to claim 1, wherein the ratio by mass of the solid content (a) of the gelatin to the solid content (b) of the latex in the heat-insulating layer, (a)/(b), is from 30/70 to 70/30.

3. The thermal transfer image-receiving sheet according to claim 1, wherein the ratio by mass of the solid content (a) of the gelatin to the solid content (b) of the latex in the heat-insulating layer, (a)/(b), is from 40/60 to 60/40.

4. The thermal transfer image-receiving sheet according to claim 1, wherein the glass transition temperature of the latex is from 50 to 85° C.

5. The thermal transfer image-receiving sheet according to claim 1, wherein the glass transition temperature of the latex is from 50 to 70° C.

6. The thermal transfer image-receiving sheet according to claim 1, wherein the latex has a mean particle size of from 50 nm to 500 nm.

7. The thermal transfer image-receiving sheet according to claim 1, wherein the latex has a mean particle size of from 50 nm to 300 nm.

8. The thermal transfer image-receiving sheet according to claim 1, wherein the latex has a number-average molecular weight of from 2,000 to 1,000,000.

9. The thermal transfer image-receiving sheet according to claim 1, wherein the ratio of the styrene recurring unit/the butadiene recurring unit in the latex is from 99/1 to 40/60.

10. The thermal transfer image-receiving sheet according to claim 1, wherein the hollow polymeric particles are non-foaming hollow polymeric particles.

11. The thermal transfer image-receiving sheet according to claim 1, wherein the hollow polymeric particles contain a polystyrene resin, an acrylic resin or a styrene-acrylic resin.

12. The thermal transfer image-receiving sheet according to claim 1, wherein the hollow polymeric particles have a glass transition temperature of from 70° C. to 200° C.

13. The thermal transfer image-receiving sheet according to claim 1, wherein the hollow polymeric particles have a mean particle size of from 0.5 μm to 5.0 μm.

14. The thermal transfer image-receiving sheet according to claim 1, wherein the hollow polymeric particles have a degree of hollowness of from 20 to 80%.

15. The thermal transfer image-receiving sheet according to claim 1, which has a lower heat-insulating layer and an upper heat-insulating layer formed on the lower heat-insulating layer.

16. The thermal transfer image-receiving sheet according to claim 15, wherein the mean particle size of the hollow polymeric particles in the upper heat-insulating layer is larger than that of the hollow polymeric particles in the lower heat-insulating layer.

17. The thermal transfer image-receiving sheet according to claim 15, wherein the content of the hollow polymeric particles in the lower heat-insulating layer is larger than that of the hollow polymeric particles in the upper heat-insulating layer.

18. The thermal transfer image-receiving sheet according to claim 1, wherein the receiving layer contains a polymer latex or a water-soluble polymer.

19. The thermal transfer image-receiving sheet according to claim 1, which is wound up into a roll.

20. A method for producing a thermal transfer image-receiving sheet having, on a support, at least one heat-insulating layer and at least one receiving layer on the heat-insulating layer, wherein the heat-insulating layer contains hollow polymeric particles, gelatin and a latex having a glass transition temperature of from 30 to 85° C., and the molecular chain of the polymer constituting the latex has a styrene recurring unit and a butadiene recurring unit, which comprises simultaneously coating on a support:

a coating liquid for heat-insulating layer containing hollow polymeric particles, gelatin and a latex having a glass transition temperature of from 30 to 85° C., wherein the molecular chain of the polymer constituting the latex has a styrene recurring unit and a butadiene recurring unit, and a coating liquid for receiving layer superimposed on the coating liquid for heat-insulating layer.

* * * * *